United States Patent [19]

Brusasca et al.

[11] Patent Number: 4,513,673

[45] Date of Patent: Apr. 30, 1985

[54] STITCH INTERRUPTING DEVICE FOR SEWING MACHINES

[75] Inventors: Gianfranco Brusasca, Cornaredo; Franco Garzulano, Gallitate Novara, both of Italy

[73] Assignee: Rockwell-Rimoldi S.p.A., Italy

[21] Appl. No.: 432,586

[22] Filed: Oct. 4, 1982

[30] Foreign Application Priority Data

Oct. 16, 1981 [IT] Italy ..... 24527 A/81

[51] Int. Cl.[3] ..... D05B 1/10; D05B 69/28

[52] U.S. Cl. ..... 112/166; 112/167; 112/DIG. 3

[58] Field of Search ..... 112/166, 167, 199, 200, 112/220, 222, DIG. 3

[56] References Cited

U.S. PATENT DOCUMENTS 2,292,724 8/1942 Thompson et al. ..... 112/197

*Primary Examiner*—Wm. Carter Reynolds

[57] ABSTRACT

A device for interrupting the formation of stitches in a sewing machine having at least two needles and a looper for each needle which are arranged to be actuated in tandem. The needles are phased to perform their functions simultaneously with a first having an elongated thread opening, and the second a conventional opening. The first needles' looper is slightly elevated and if no lack of phasing exists between the needles and their loopers, the elevated looper will cooperate with its needle adjacent the upper end of the thread hole and the other looper cooperates with its needle in a conventional manner. Should there be a lack of phasing, the elevated looper cooperates with its needle midway between the length of the thread hole which causes the other looper to pass beneath the hole of its needle thus interrupting the formation of stitches by the latter needle.

4 Claims, 5 Drawing Figures

STITCH INTERRUPTING DEVICE FOR SEWING MACHINES

BACKGROUND OF THE INVENTION

The present invention pertains to a sewing machine which is capable of forming more than a single line of stitches by means of a separate needle for each seam or line of stitching and that includes a separate looper operatively associated with each needle which are arranged to actuate in tandem. More particularly the invention pertains to a device for interrupting at least one line of stitching while the other line spaced from and parallel therewith continues to be formed.

Sewing machines with dual needles and independent loopers functioning in tandem with their respective needles are well-known and by means of a selective operating control on such machines, both loopers can be displaced to effect an out-of-phase condition thereof with the paths of their respective needles. Such a condition provides a desired suspension of the formation of both the lines of stitching.

The type of sewing machine described supra is particularly set forth in U.S. Pat. No. 2,292,724 wherein its teachings illustrate and describe means which are adapted to cause both the loopers to rotate through a certain angle to create a delay in the stitch-forming phase with respect to their needles thus causing a cessation of stitch formation. An object of the present invention is to provide this type of sewing machine which is utilized in the garment forming industry with a means whereby it is possible to selectively interrupt the seam being formed by one or the other needle, or by both.

SUMMARY OF THE INVENTION

Sewing machines to which the invention is applicable have at least two loopers pivoted in tandem and each is operatively associated with a needle for effecting lines of stitching extending parallel to each other. The invention provides a means for interrupting at least one line of stitching by providing the needle which is not interrupted and that continues to form stitches with an upwardly directed elongated thread hole and a raised looper operatively associated with this needle. The looper which cooperates with this needle is elevated in such a manner that when there is no lack of phasing between the needles and the paths of their loopers, this looper cooperates with its needle at a position adjacent the upper end of the elongated thread hole and the other looper cooperates with its needle in a conventional manner. When a lack of phasing between the needles and their loopers exists, the elevated looper cooperates with the elongated hole of its needle approximately midway between the ends thereof thus causing the other looper to pass below the hole of its respective needle so that the latter fails to form stitches. Additionally elements of the invention include a spacer inserted between the looper holder and the looper operatively associated with the needle having the elongated hole which effectively raises the position of said looper. In order to provide a lack of phasing between the needles and their loopers, a pneumatic cylinder is provided having a piston to displace the fulcrums of both loopers so as to cause the path of each to be varied by inclining them downwardly. A coil spring returns the loopers to their initial position when the pneumatic cylinder is no longer supplied with power and the spacer can be used with either looper as long as it corresponds to the needle having the elongated thread hole.

When a spacer is not utilized as described and an out-of-phase condition is established, there is a cessation of formation of both seams of stitches.

Futher characteristics and advantages will become more fully apparent by reference to the appended claims and as the following detailed description proceeds in reference to the figures of drawing wherein.

DESCRIPTION OF THE PREFERRED EMBODIMENT

Figure 1:
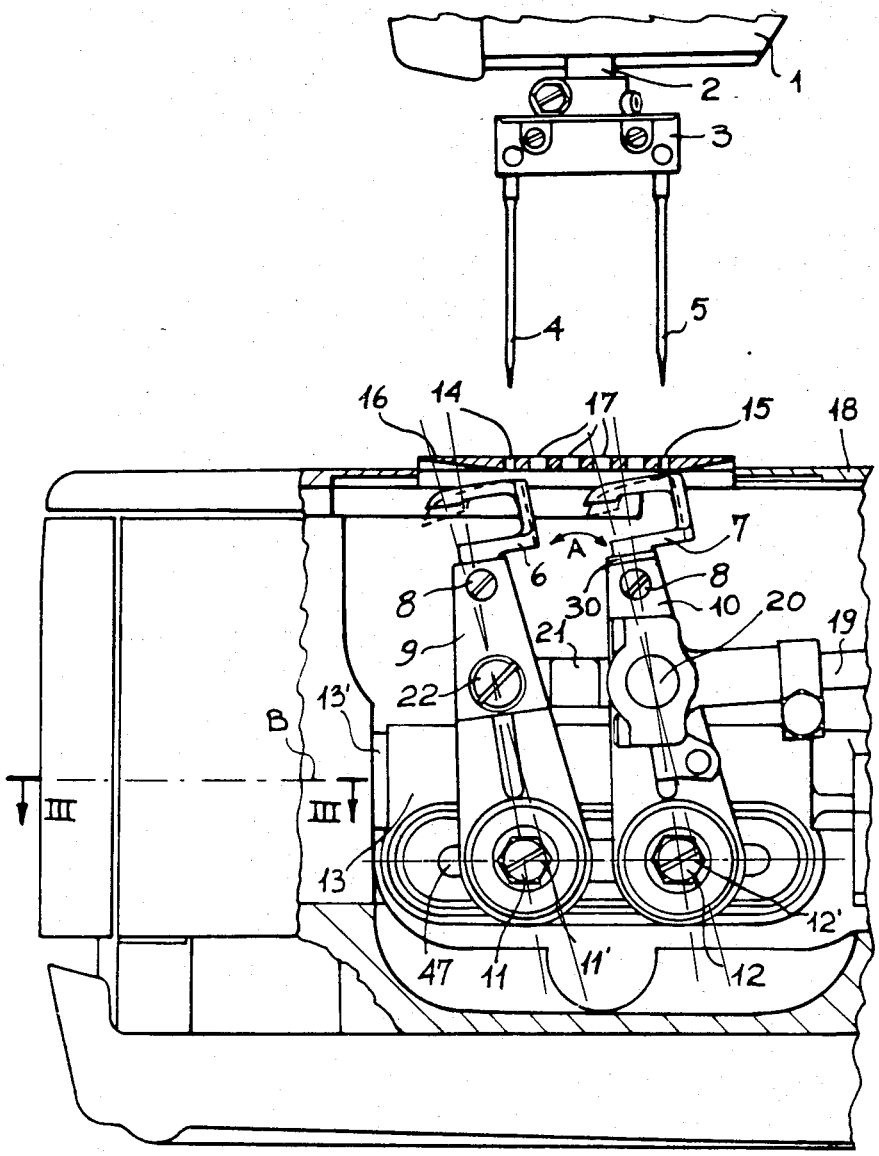
FIG. 1 is an elevational view partially in section of a portion of a sewing machine to which the invention has been applied.

Referring to FIG. 1 wherein only as much of a sewing machine structure is depicted as is necessary for a complete understanding of the invention, there is shown a portion of the machine's head 1 from which a needle bar 2 projects. This needle bar 2 carries a clamp 3 to which needles 4 and 5 are fixed and that cooperate with loopers 6 and 7 respectively when performing their intended functions. These loopers 6 and 7 are fixed by means of screws 8 to looper holders 9 and 10 that are pivotably supported at fulcrums 11 and 12 respectively on a sleeve coupling 13.

The needle bar 2 as is well known reciprocates vertically which causes needles 4 and 5 which have eyes 4' and 5', respectively, to enter and be withdrawn from holes 14 and 15 provided in a conventional needle plate 16. This needle plate 16 is provided with the usual array of slots 17 through which rows of teeth of a feed dog not shown are caused to pass so as to effect advance of workpiece as lines of stitches are formed by the needles 4 and 5 cooperating with their respective loopers 6 and 7.

The needle plate 16 is fixed to the machines base 18 on which a workpiece is caused to slide as it is gradually sewn and advanced through the stitching zone. As is well known to form double chain stitches the movement of each looper that is in phase with the alternating movement of its respective needle follows an elliptical pathway that is substantially horizontal and obtained by the alternating longitudinal movement of the loopers 6 and 7 in the sense depicted by the indicating arrow "A" in FIG. 1. This movement is provided by a rod 19 pivotably connected to the looper holder 10 by means of fulcrum 20 and by an alternating transverse movement parallel to the lines of stitching that is transmitted to these loopers by a well known means not shown. These movements are transmitted in a positive manner to each of the loopers for they are interconnected by means of a connecting rod 21 which pivots at fulcrum 20 on the looper 10 and at 22 on the looper holder 9.

Figure 3:
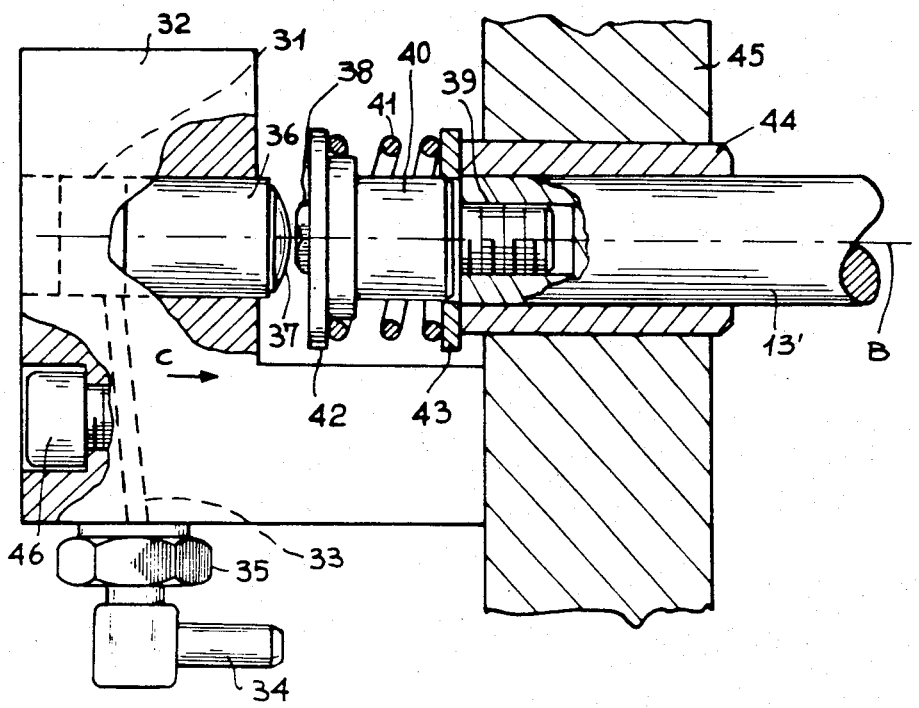
FIG. 3 is a sectional view looking in the direction of the indicating arrows of line III—III in FIG. 1.

The transverse movement, which is parallel to the lines of stitching is transmitted to the loopers 6 and 7 by the sleeve coupling 13 that is caused to oscillate about axis B (FIGS. 1 and 3) of shaft 13' by a well known means not shown.

Control of the loopers 6 and 7 as described supra causes them to be actuated in tandem so that they follow elliptical pathways that are suitably phased with the alternating movements of their respective needles 4 and 5 and effectively form parallel lines of stitching.

According to the object of the invention, it is necessary when performing certain seaming operations during the manufacture of garments, to interrupt one or the other of the parallel lines of stitching or both in certain areas of the workpiece.

Figure 5:
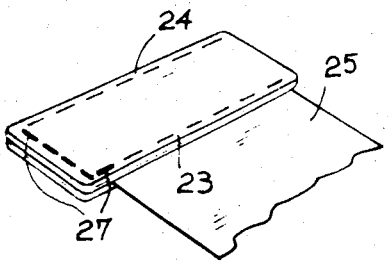
FIGS. 4 and 5 are perspective views of first and second stages respectively of the particular type of stitching that the device according to the invention is adapted to perform.
Figure 4:
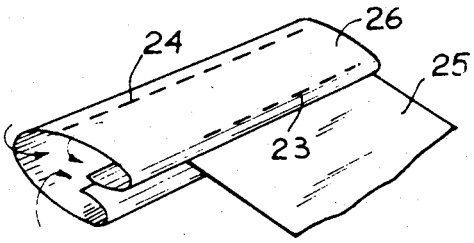

An example of interrupting a seaming operation during garment manufacture is shown in FIGS. 4 and 5 where lines of stitching depicted by numerals 23 and 24 are utilized to join trousers 25 to a waistband 26. As shown, it is necessary that the edges of the waistband adjacent the edge of the trousers be folded inwardly and before completing the operation the end portion must also be folded back within itself. During this seaming operation, the seam formed by needle 4 must be interrupted while the other seam formed by needle 5 continues along the waistband 26.

After the end portion of the waist band 26 has been folded inwardly, the seam or line of stitching 24 is extended a greater distance than the line of stitching 23 which being slightly shorter provides a means for bracing stitching 27 (FIG. 5) which can be of lesser length than that which would be required if it were necessary to stop both seams short of the end of the waistband.

Figure 2:
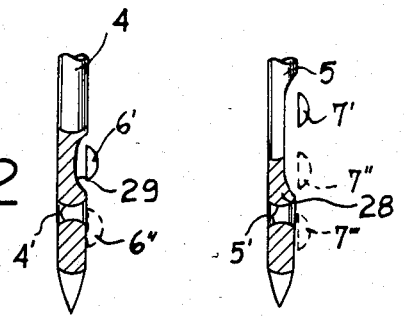
FIG. 2 is an enlarged view of a portion of the machine's needles showing by means of full and phantom lines the positions of their cooperating loopers.

In order to provide means for seam interruption, the right-hand needle 5 is provided with a thread opening or hole 28 which is elongated upwardly and the thread opening or hole depicted by numeral 29 for the left hand needle 4 is of conventional size. Additionally the leg of the right hand looper 7 has a spacer 30 inserted between it and its looper holder 10 so that said looper is elevated to an operating position a distance equivalent to the thickness of said spacer. With the looper 7 elevated in this manner, it is caused to cooperate with the thread hole 28 of its needle in a position depicted by numeral 7' in FIG. 2. Simultaneously the tip of looper 6 cooperates with the hole 29 of its needle at a location depicted by numeral 6' in FIG. 2 and the combination provide the condition whereby both seams or lines of stitching 23 and 24 are formed at the same time.

To create a condition where there is a lack of phasing between the needles and loopers, a pneumatic cylinder 31 is provided that is formed within a support member 32 located below the base 18 of the machine. Air is caused to enter this pneumatic cylinder 31 by means of a conduit 33 which in turn is connected to an air supply connector 34 that is attached to the support member 32 by means of a nut 35. When air is caused to enter the pneumatic cylinder 31, piston 36 is moved in the direction of arrow c. This piston has a dome-shaped push rod 37 threaded thereon so that its position can be adjusted relative to a head 38 of a bolt 39 which is threaded into the looper holder shaft 13' that is fixed to the coupling sleeve 13. Shaft 13' adjacent one end has a surface identified by numeral 40 in FIG. 3 on which a coil spring 41 is assembled. This surface 40 is located intermediate a flange 42 and a ring nut 43 that is urged against one end of a bushing 44 that is assembled in a support element 45 which in turn is attached to the support member 32 by means of bolts 46.

When air enters the pneumatic cylinder 31 its piston which is caused to move in the direction of arrow c presses against shaft 13' causing the coupling sleeve 13 to be displaced to the extent that the points 11 and 12 of pivoting of the looper holders 9 and 10 in slot 47 become displaced to the extent that they assume the positions depicted by numerals 11' and 12' in FIG. 1.

In these positions, the tips of the loopers 6 and 7 are caused to assume the dash line positions shown in FIG. 1 which tilts them downwardly so that the paths of the loopers are altered with respect to the pathways of their respective needles. By altering the paths of the loopers in this manner, that loop of thread from needle 4 is not taken by the tip of the looper 6 because its position is that shown in FIG. 2 whereby the tip of looper 6 is located in 6" below the hole 29 of its needle and the tip of looper 7 is at a position depicted by numeral 7" which is that area adjacent the central area of hole 28. Under these conditions the only cessation of stitches are those which would be formed by needle 4.

When it is desired to interrupt the stitching provided by the right-hand needle only, the spacer 30 is assembled between the looper 6 and the looper holder 9 and the needle 5 having the elongated thread hole 28, is substituted by the needle 4 which is used in place of needle 5.

When it is necessary to interrupt both seams or lines of stitching at the same time, the needles 4 and 5 are utilized but the spacer 30 is eliminated. With this arrangement the pneumatic cylinder 31 creates a lack of phasing between both needles and their respective loopers and both seams or lines of stitches fail to be formed. This condition is created because the tip of the left hand looper (FIG. 2) is located at the position depicted by numeral 6" which is below the hole 29 and the tip of the right hand looper is in that position depicted by 7''' which is also below that of hole 28.

When it becomes necessary to return to the initial in-phase condition between the needles and their respective loopers air to the pneumatic cylinder is discontinued and by means of the coil spring 41 the coupling sleeve 13 is returned to its original position whereat the looper holders 9 and 10 are again pivotable about fulcrums 11 and 12.

Although the present invention has been described as being applicable to sewing machines utilizing two needles and two loopers operating in tandem, it should be understood that the invention is also applicable to machines having twin double needles and double loopers operating in tandem and generally to machines having sets of needles each operating in conjunction with a single looper. It should also be understood that air is admitted into conduit 33 by the actuation of a valve which may be actuated by a pedal not shown or alternatively by a photocell means which is controlled by the workpiece being sewn.

Although the present invention has been described in connection with a preferred embodiment, it is to be understoood that modifications and variations may be resorted to without departing from the spirit and scope of the invention as those skilled in the art will readily understand.

Such modifications and variations are considered to be within the purview and scope of the invention and the appended claims.

We claim:

1. A device for interrupting the formation of at least one line of stitching in a sewing machine of the type having a support structure for pivotably supporting at least two looper holders in tandem with individual loopers mounted on each holder and at least one needle in operative association with each looper for forming spaced and parallel lines of stitching, said device comprising:

a. means defining an elongated thread hole in one of the needles;

b. means for elevating that looper associated with the needle having the elongated thread hole on its looper holder to an operating level above the looper with which it pivots in tandem; and c. means for displacing the points of pivot of said looper holders for effecting continued formation of stitches by the combination of the needle with said elongated thread hole and said elevated looper, and a cessation of stitches by the other needle and its looper.

2. The structure according to claim 1 wherein said elevating means defines a spacer assembled intermediate the looper holder and the looper operatively associated with the needle having said elongated thread hole.

3. The structure according to claim 1 wherein said displacing means defines a pneumatic cylinder having a piston operatively connected to both said looper holders for effecting simultaneous displacement of both the loopers.

4. The structure according to claim 3 wherein said device includes a coil spring for returning the looper holders and loopers to their initial positions upon a cessation of air into said pneumatic cylinder.

* * * * *